United States Patent [19]

Vredenburg, Sr.

[11] Patent Number: 4,550,755

[45] Date of Patent: Nov. 5, 1985

[54] VACUUM BAG FILLER

[76] Inventor: Edric W. Vredenburg, Sr., 2690 Milo Way, Salt Lake City, Utah 84117

[21] Appl. No.: 507,476

[22] Filed: Jun. 24, 1983

[51] Int. Cl.[4] ..... B65B 1/28

[52] U.S. Cl. ..... 141/59; 141/67; 141/114; 141/314

[58] Field of Search ..... 141/1-12, 141/67, 68, 93, 114, 313-317, 37-65, 69-83

[56] References Cited

U.S. PATENT DOCUMENTS 3,994,532 11/1976 Hahn ..... 141/67

4,311,173 1/1982 Sailors ..... 141/68

*Primary Examiner*—Houston S. Bell, Jr.

[57] ABSTRACT

A bag filling machine is provided for filling bags with a finely divided particulate material from a hopper wherein the material in the hopper is partially fluidized and is injected into a bag through a nozzle with a blast of air and without the employment of a machanical impeller. Vacuum means are provided around the nozzle to aid in the filling operation by deaerating the particulate material and also to hold down dust and to recover any material which might blow out of the bag.

3 Claims, 6 Drawing Figures

39
49
41
51
53
49

41
49
39
49
4
4
43
45
51
45
65
37
47
7
33
35
23
15
11
13
9
15

59
55
57
41

55
57
59
6
6

VACUUM BAG FILLER

SUMMARY OF THE INVENTION

Most machines for filling bags with a powdered or finely divided material employ a mechanical impeller acting in a hopper to propel the material into a bag. With certain materials which are powdery, such mechanical impellers do not work well and, of course, the mechanical impeller introduces a mechanical complexity into the filler.

Although gravity feed packets which do not employ mechanical impellers have been known in the past, they are not particularly efficient with certain classes of material.

In accordance with the present invention, a bag filling machine is provided wherein the hopper has porous walls so that air can be introduced through the porous walls in the hopper fluidizing at least the marginal edges of the material within the hopper. Preferably, the fluidization is not sufficient to fluidize the entire mass so that the material near the center of the hopper is not fluidized. An air inlet is provided near the nozzle and this serves to propel the material into the bag. In addition, a vacuum passage is provided around the edges of the nozzle so that, as material is blown into the bag, at the same time air is sucked out of the bag. This aids in filling the bag by deaerating the particulate material and also prevents dust from escaping from the bag into the air. Also by employing the vacuum, any material which is exhausted from the bag can be salvaged and recycled.

Thus, the present invention provides an efficient bag packaging machine which does not require the use of a mechanical impeller or auger Other features and advantages of the invention will be brought out in the balance of the application.

DESCRIPTION OF THE PREFERRED EMBODIMENTS

Figures 1, 2:
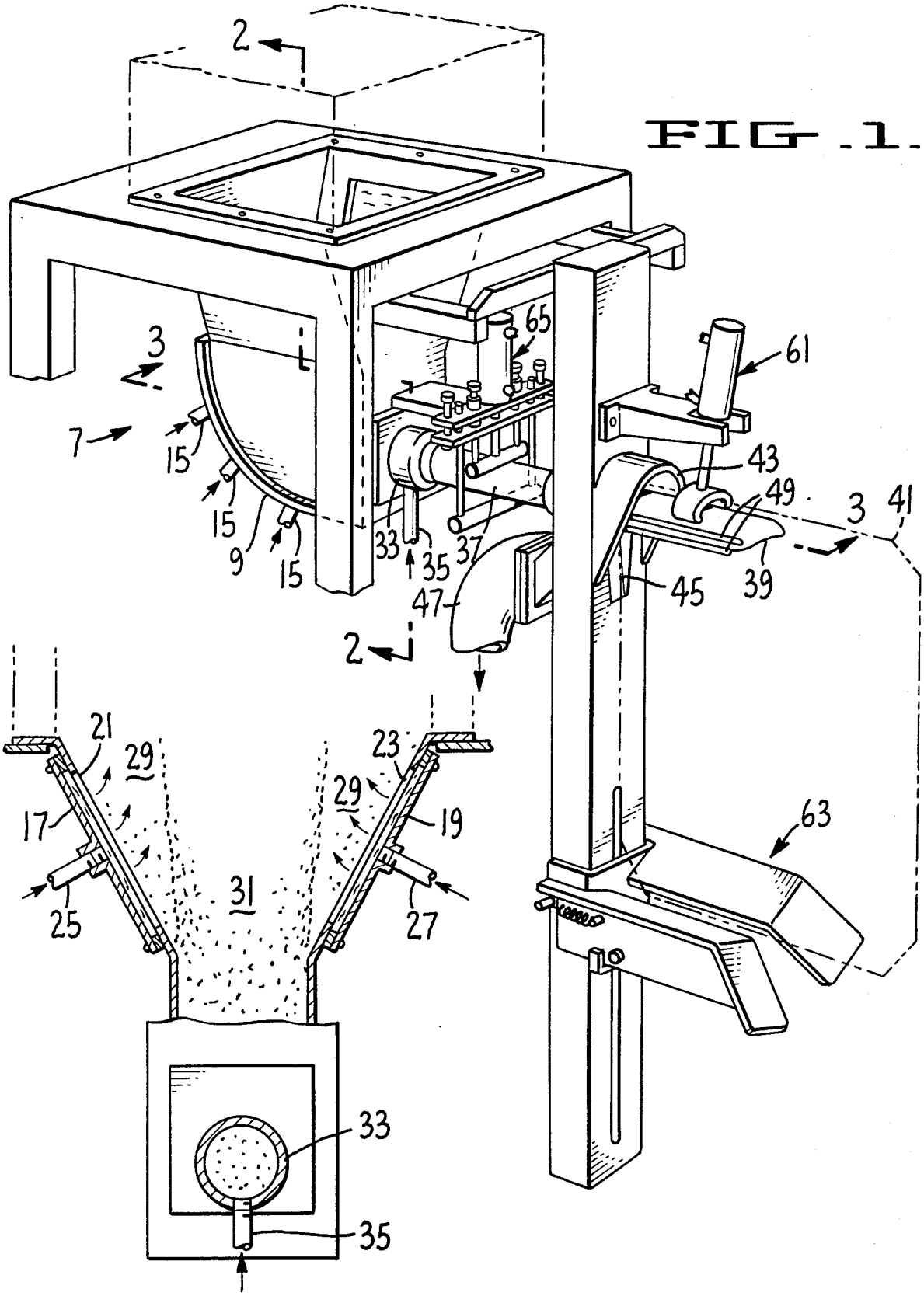
FIG. 1 is a perspective view of a bag packing machine embodying the present invention.
FIG. 2 is a section on the line 2—2 of FIG. 1.

Referring now to the drawings by reference characters, the machine includes a hopper generally designated 7 having a rounded metal bottom 9 with an inner porous membrane 11 spaced slightly therefrom leaving a small space 13 between the bottom 9 and the porous member 11. Air inlets 15 are provided for maintaining a positive air pressure within the space 13. Similarly, the sides 17 and 19 are provided with porous membranes 21 and 23 with air inlets 25 and 27. The flow of air through the inlets 15, 25 and 27 is controlled in such a manner that the material near the porous membrane is fluidized yet the large central body of material is not fluidized. This is best seen in FIG. 2 wherein the areas designated 29, adjacent to the membranes, is fluidized yet the main body of material at 31 is substantially not fluidized. The operation of such a hopper with fluidization occurring only near the surfaces of the hopper is fully set forth in my co-pending application Ser. No. 361,897 filed Mar. 25, 1982, now abondaned the contents of which are incorporated by reference. By employing fluidization only at the margins, fluidized material acts as a "lubricant" so that the main body of material flows easily through the bag feeding machine yet an excessive amount of air is not introduced as would be the case with complete fluidization.

Material flows from the hopper 7 into the outlet 33 where a blast of air is introduced through pipe 35. The blast of air introduced through pipe 35 causes the material to be discharged through the rubber tube 37 and into the nozzle 39 then into a waiting bag 41. Surrounding the nozzle is a hood 43 with a passage 45 within the hood and which extends around the top of the hood and downward. This leads to a source of vacuum 47. In this embodiment of the invention, nozzle 38 is provided with a series of rods 49 which run parallel to the nozzle and which prevent the flap 51 of the bag from being drawn tight against the outside of the nozzle by the vacuum. Thus, there is some space 53 left at all times so that the vacuum cannot be rendered ineffective by the vacuum sucking flap 51 against the outside of the nozzle.

Figures 3, 4, 5, 6:
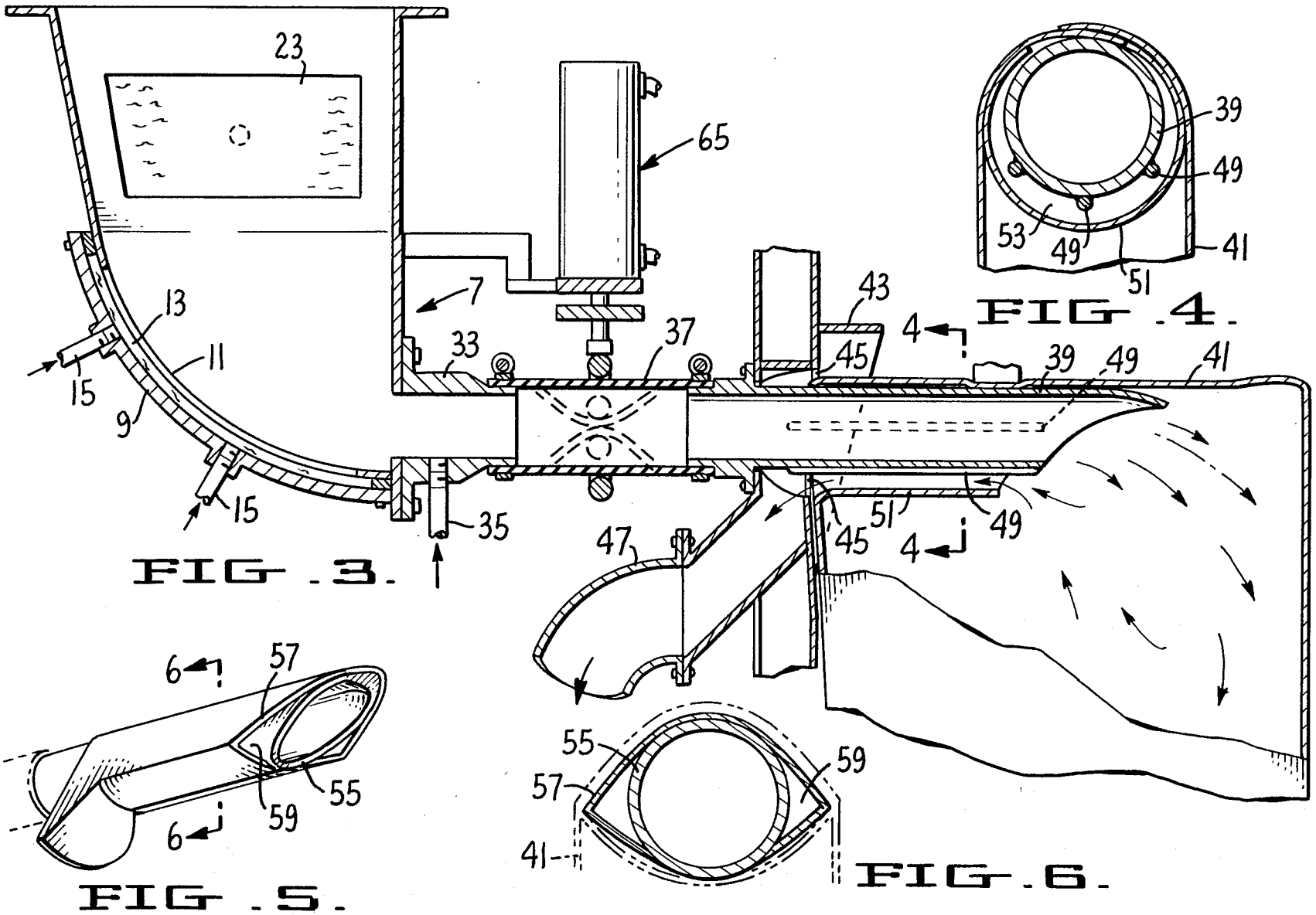
FIG. 3 is a section on the line 3—3 of FIG. 1.
FIG. 4 is a section on the line 4—4 of FIG. 3 showing one form of nozzle which may be employed.
FIG. 5 is a perspective view of another form of nozzle.
FIG. 6 is an enlarged section on the line 6—6 of FIG. 5.

In FIGS. 5 and 6, an alternate form of nozzle is employed which has a central tube 55 with an external tube 57 leaving a space 59 between the tubes. This space 59 is connected to the source of vacuum 47 while the inner tube 55 is employed for the bag filling operation in the same manner as tube 39, previously described.

In a practical embodiment of the invention, the bag filling machine might be provided with a bag gripping device 61, a saddle 63 which tilts to discharge a bag when the filling operation is complete and a shut-off mechanism 65. These form no part of the present invention and are fully described in my co-pending patent application Ser. No. 294,476 filed Aug. 20, 1981, now U. S. Pat. No. 4,398,576 the contents of which are incorporated by reference.

Although specific embodiments of the invention have been described, it will be understood that these are only for purposes of illustration and that many variations can be made in the structure shown without departing from the spirit of this invention.

I claim:

1. A bag filling machine for packing a finely divided particulate material into a bag, comprising in combination:

(a) a hopper for receiving a supply of said material, (b) said hopper having at least some porous walls and means for directing air through said walls to fluidize said material along the walls, leaving the main body substantially not fluidized of said material, (c) an outlet near the bottom of said hopper leading to a discharge nozzle, (d) means for blasting air into said discharge at the bottom of said hopper adjacent the nozzle, and (e) vacuum means at least partially surrounding said discharge nozzle.

2. The bag filling machine of claim 1 wherein the nozzle has a series of spaced parallel projections on the outer surface thereof, to keep the neck of a bag spaced from the outer surface and thus provide a return vacuum passage between the outer surface of the nozzle and a bag on said nozzle.

3. The bag filling machine of claim 1 wherein the nozzle has an inner tube leading to the hopper and an outer tube leading to the vacuum means.

* * * * *